US009343075B2

(12) United States Patent
Matsuo

(10) Patent No.: US 9,343,075 B2
(45) Date of Patent: May 17, 2016

(54) VOICE PROCESSING APPARATUS AND VOICE PROCESSING METHOD

(71) Applicant: FUJITSU LIMITED, Kawasaki-shi, Kanagawa (JP)

(72) Inventor: Naoshi Matsuo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 176 days.

(21) Appl. No.: 14/323,151

(22) Filed: Jul. 3, 2014

(65) Prior Publication Data

US 2015/0066487 A1 Mar. 5, 2015

(30) Foreign Application Priority Data

Aug. 30, 2013 (JP) ..... 2013-180685

(51) Int. Cl.

| | |
|---|---|
| ***G10L 19/00*** | (2013.01) |
| ***G10L 21/00*** | (2013.01) |
| ***G10L 19/02*** | (2013.01) |
| ***G10L 21/0208*** | (2013.01) |

(52) U.S. Cl.

CPC ..... *G10L 19/0212* (2013.01); *G10L 21/0208* (2013.01)

(58) Field of Classification Search

USPC ..... 704/207, 241, 205, 204, 267, 200, 704/200.1, 500, 501, 503

See application file for complete search history.

(56) References Cited

U.S. PATENT DOCUMENTS 6,182,042 B1 * 1/2001 Peevers ..... G10H 7/08 704/203
6,449,590 B1 * 9/2002 Gao ..... G10L 19/005 704/211
6,978,241 B1 * 12/2005 Sluijter ..... G10L 19/02 704/205
7,676,362 B2 * 3/2010 Boillot ..... G10L 19/26 704/205

(Continued)

FOREIGN PATENT DOCUMENTS

JP 2001-013968 1/2001
JP 2003-348041 12/2003

(Continued)

OTHER PUBLICATIONS

Yang et al., (Yang et al.,"Pitch Synchronous Modulated Lapped Transform of the Linear Prediction Residual of Speech," Oct. 1998; Proceedings of ICSP '98, pp. 591-594).*

(Continued)

*Primary Examiner* — Edgar Guerra-Erazo
(74) *Attorney, Agent, or Firm* — Fujitsu Patent Center

(57) ABSTRACT

A voice processing apparatus includes: a dividing unit which divides a voice signal into frames in such a manner that any two successive frames overlap each other by a predetermined amount; a first windowing unit which multiplies each frame by a first windowing function that attenuates a signal at both ends of the frame; an orthogonal transform unit which computes a frequency spectrum for each frame multiplied by the first windowing function; a frequency signal processing unit which computes a corrected frequency spectrum; an inverse orthogonal transform unit which computes a corrected frame by applying an inverse orthogonal transform to the corrected frequency spectrum; a second windowing unit which multiplies each corrected frame by a second windowing function that attenuates a signal at both ends of the corrected frame; and an addition unit which adds up the each corrected frame multiplied by the second windowing function, sequentially in time order.

15 Claims, 8 Drawing Sheets

(56) References Cited

U.S. PATENT DOCUMENTS

| | | | | |
|---|---|---|---|---|
| 8,781,819 | B2 * | 7/2014 | Kawahara | G10L 13/033 704/207 |
| 8,908,881 | B2 * | 12/2014 | Sato | G10L 21/0272 381/104 |
| 2001/0021904 | A1 * | 9/2001 | Plumpe | G10L 19/06 704/209 |
| 2005/0143989 | A1 | 6/2005 | Jelinek | |
| 2005/0249272 | A1 * | 11/2005 | Kirkeby | G10L 21/02 375/232 |
| 2006/0149532 | A1 * | 7/2006 | Boillot | G10L 19/26 704/203 |
| 2008/0033585 | A1 * | 2/2008 | Zopf | G10L 19/005 700/94 |
| 2008/0046252 | A1 * | 2/2008 | Zopf | G10L 19/005 704/501 |
| 2008/0052065 | A1 * | 2/2008 | Kapoor | G10L 19/18 704/221 |
| 2010/0100390 | A1 | 4/2010 | Tanaka | |
| 2011/0015931 | A1 * | 1/2011 | Kawahara | G10L 13/033 704/264 |
| 2012/0082323 | A1 * | 4/2012 | Sato | G10L 21/0272 381/94.3 |

FOREIGN PATENT DOCUMENTS

| | | | |
|---|---|---|---|
| JP | 2009-033570 | | 2/2009 |
| JP | 2013-117639 | | 6/2013 |
| WO | 01/37265 | A1 | 5/2001 |
| WO | 2006/137425 | | 12/2006 |

OTHER PUBLICATIONS

EESR—Extended European Search Report of European Patent Application No. 14177041.2 dated Feb. 19, 2015.

* cited by examiner

VOICE PROCESSING APPARATUS AND VOICE PROCESSING METHOD

CROSS-REFERENCE TO RELATED APPLICATION

This application is based upon and claims the benefit of priority of the prior Japanese Patent Application No. 2013-180685, filed on Aug. 30, 2013, the entire contents of which are incorporated herein by reference.

FIELD

The embodiments discussed herein are related to a voice processing apparatus and a voice processing method.

BACKGROUND

With the proliferation of voice input devices, such as vehicle-mounted hands-free phones or mobile phones, that can be used in various environments, voice communication and voice recognition have come to be conducted more than ever before in noisy environments inside vehicles or in outdoor locations. In such noisy environments, the intelligibility of the speaker's voice being heard at the remote end or the accuracy of voice recognition may drop because of background noise, such as noise from running vehicles, that is gathered by a microphone together with the speaker's voice. To address this, voice processing techniques are used which analyze the frequency of the captured voice signal, estimate the noise components contained in the voice signal, and eliminate or reduce the noise components contained in the voice signal. According to such voice processing techniques, the voice signal is divided into overlapping frames and, after multiplying each frame by a windowing function such as a Hanning window, an orthogonal transform is applied to the frame to obtain the frequency spectrum. Then, by applying signal processing such as noise elimination to the frequency spectrum, a corrected frequency spectrum is obtained. Subsequently, an inverse orthogonal transform is applied to the corrected frequency spectrum to obtain a frame-by-frame corrected voice signal and, by sequentially adding up the frames of the thus corrected voice signals in overlapping fashion, a final corrected voice signal is obtained.

However, in the case of the corrected voice signal obtained by applying an inverse orthogonal transform to the corrected frequency spectrum obtained as a result of the frame-by-frame signal processing, the signal value may not be zero at the frame end, and the corrected voice signal may be discontinuous when the successive frames are added up. If this happens, periodic noise proportional to the frame length will be superimposed on the corrected voice signal. This can result in a degradation of voice communication quality or a degradation of the accuracy of voice recognition. To address this problem, a technique in which, each time the amount of overlap between successive frames is increased, the degree of similarity between the signal subjected to filtering and an arbitrary signal is computed, and the amount of overlap is set based on the degree of similarity has been proposed (for example, refer to Japanese Laid-open Patent Publication No. 2013-117639).

SUMMARY

According to the technique disclosed in Japanese Laid-open Patent Publication No. 2013-117639, the amount of overlap is set, for example, in the range of 50% to 87.5%. In this case, the number of frames used to compute the corrected voice signal at any given time increases as the amount of overlap increases. As a result, if there is any frame whose signal value does not become zero at the frame end, since the proportion that the signal at the frame end accounts for in the corrected voice signal decreases, the quality degradation of the corrected voice signal can be suppressed.

However, as the amount of overlap increases, the number of frames per unit time increases. For example, the number of frames per unit time when the amount of overlap is set to (100−(50/n))% (where n is an integral multiple of 2) is n times the number of frames when the amount of overlap is set to 50%. As the number of frames per unit time increases, the amount of computation needed for signal processing increases. For example, when performing signal processing by using a processor built into a vehicle-mounted apparatus or a mobile phone or the like, an increase in the amount of computation is not desirable because the processing capability of such a processor is limited. In particular, since orthogonal transform and inverse orthogonal transform operations involve a relatively large amount of computation, an increase in the number of orthogonal transform and inverse orthogonal transform operations is not desirable.

According to one embodiment, a voice processing apparatus is provided. The voice processing apparatus includes: a dividing unit which divides a voice signal into frames, each frame having a predetermined length of time, in such a manner that any two temporally successive frames overlap each other by a predetermined amount; a first windowing unit which multiplies each frame by a first windowing function that attenuates a signal at both ends of the frame; an orthogonal transform unit which applies an orthogonal transform to each frame multiplied by the first windowing function to compute a frequency spectrum on a frame-by-frame basis; a frequency signal processing unit which applies signal processing to the frequency spectrum to compute a corrected frequency spectrum on a frame-by-frame basis; an inverse orthogonal transform unit which applies an inverse orthogonal transform to the corrected frequency spectrum to compute a corrected frame on a frame-by-frame basis; a second windowing unit which multiplies each corrected frame by a second windowing function that attenuates a signal at both ends of the corrected frame; and an addition unit which computes a corrected voice signal by adding up the corrected frames, each multiplied by the second windowing function, sequentially in time order while allowing one to overlap another by the predetermined amount.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A voice processing apparatus will be described below with reference to the drawings.

The voice processing apparatus divides a voice signal into frames in such a manner that temporally successive frames overlap each other by a predetermined amount (for example, 50% of the frame length) and, after multiplying each frame by a windowing function that attenuates the signal at both ends, performs an orthogonal transform, frequency spectrum signal processing, and an inverse orthogonal transform. In this process, the voice processing apparatus judges whether the corrected voice signal becomes discontinuous or not when the corrected frames obtained by the inverse orthogonal transform are added up while allowing one to overlap another by the prescribed amount. If it is determined that the corrected voice signal becomes discontinuous, the voice processing apparatus adds up the corrected frames after multiplying each corrected frame by a windowing function that attenuates the signal at both ends. In this way, the voice processing apparatus suppresses periodic noise that occurs as a result of voice processing applied to the frequency spectrum, without changing the amount of frame overlapping.

Figure 1:
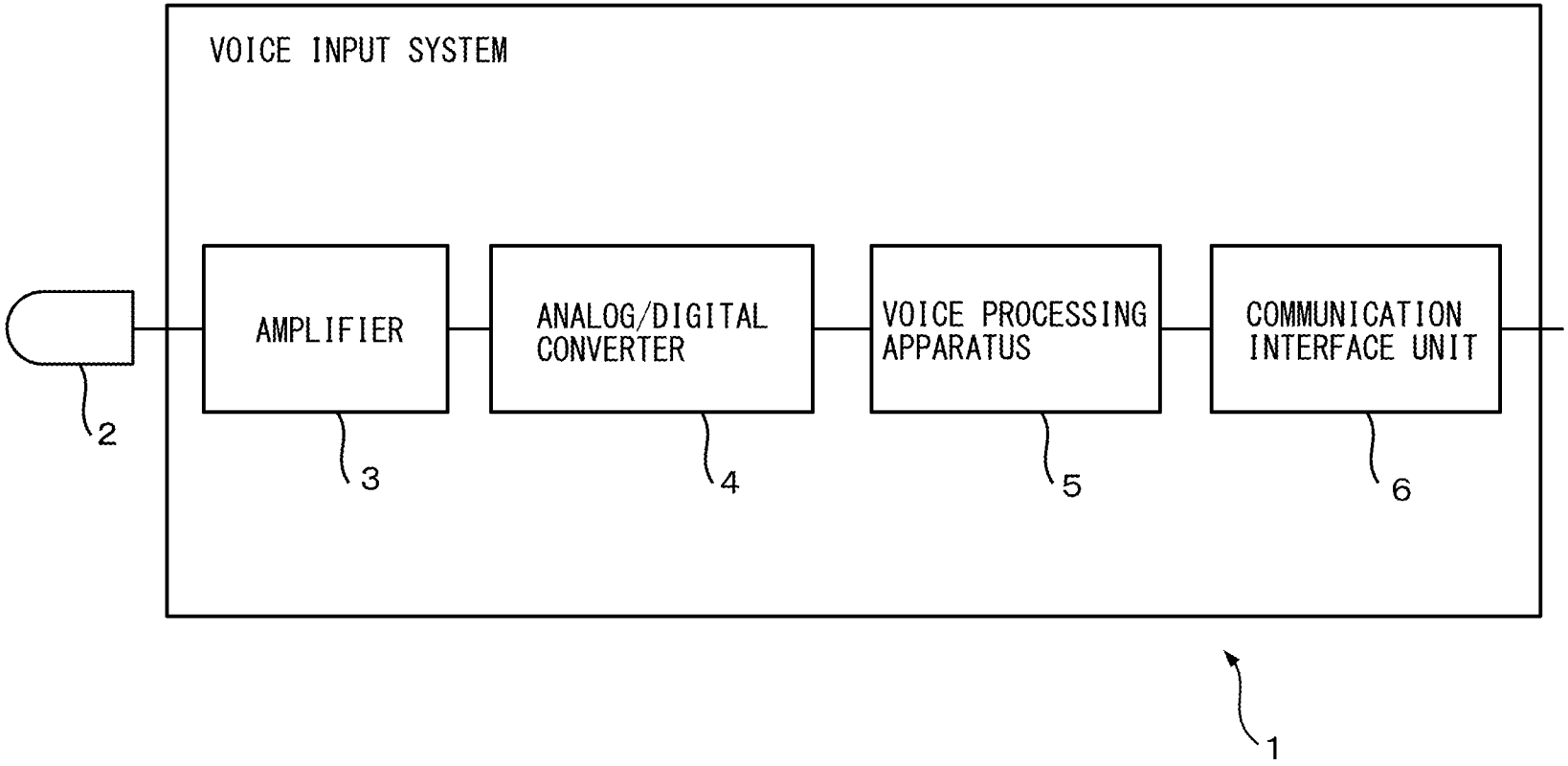
FIG. 1 is a diagram schematically illustrating the configuration of a voice input system equipped with a voice processing apparatus.

FIG. 1 is a diagram schematically illustrating the configuration of a voice input system equipped with the voice processing apparatus. In the present embodiment, the voice input system 1 is, for example, a vehicle-mounted hands-free phone, and includes, in addition to the voice processing apparatus 5, a microphone 2, an amplifier 3, an analog/digital converter 4, and a communication interface unit 6.

The microphone 2 is one example of a voice input unit, which captures sound in the vicinity of the voice input system 1, generates an analog voice signal proportional to the intensity of the sound, and supplies the analog voice signal to the amplifier 3. The amplifier 3 amplifies the analog voice signal, and supplies the amplified analog voice signal to the analog/digital converter 4. The analog/digital converter 4 produces a digitized voice signal by sampling the amplified analog voice signal at a predetermined sampling frequency. The analog/digital converter 4 passes the digitized voice signal to the voice processing apparatus 5. The digitized voice signal will hereinafter be referred to simply as the voice signal.

The voice signal may contain a noise component, such as background noise, in addition to a signal component intended to be captured, for example, the voice of the user using the voice input system 1. Therefore, the voice processing apparatus 5 includes, for example, a digital signal processor, and generates a corrected voice signal by suppressing the noise component contained in the voice signal. The voice processing apparatus 5 passes the corrected voice signal to the communication interface unit 6. The voice processing that the voice processing apparatus 5 applies to the voice signal need not be limited to the suppression of the noise component, but may include, in combination with the suppression of the noise component, other types of processing such as the amplification of the voice signal itself and the enhancement of the intended signal component.

The communication interface unit 6 includes a communication interface circuit for connecting the voice input system 1 to another apparatus such as a mobile phone. The communication interface circuit may be, for example, a circuit that operates in accordance with a short-distance wireless communication standard, such as Bluetooth (registered trademark), that can be used for voice signal communication, or a circuit that operates in accordance with a serial bus standard such as Universal Serial Bus (USB). The corrected voice signal from the voice processing apparatus 5 is transferred to the communication interface unit 6 for transmission to another apparatus.

Figure 2:
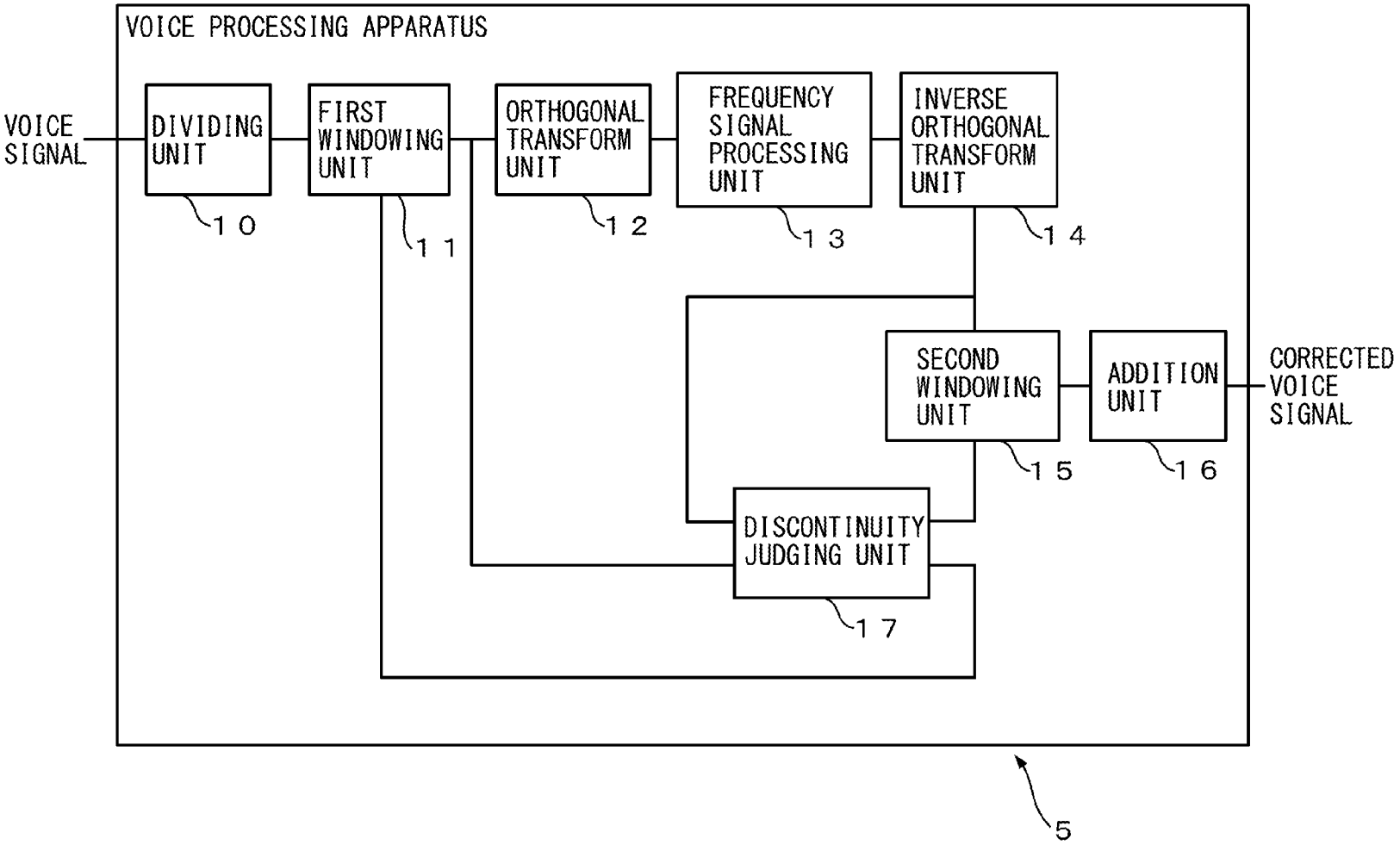
FIG. 2 is a diagram schematically illustrating the configuration of a voice processing apparatus according to a first embodiment.

FIG. 2 is a diagram schematically illustrating the configuration of the voice processing apparatus 5 according to the first embodiment. The voice processing apparatus 5 includes a dividing unit 10, a first windowing unit 11, an orthogonal transform unit 12, a frequency signal processing unit 13, an inverse orthogonal transform unit 14, a second windowing unit 15, an addition unit 16, and a discontinuity judging unit 17. These units constituting the voice processing apparatus 5 are functional modules implemented, for example, by executing a computer program on the digital signal processor.

The dividing unit 10 divides the voice signal into frames, each having a predetermined frame length (for example, several tens of milliseconds), in such a manner that any two successive frames overlap each other by a predetermined amount. In the present embodiment, the dividing unit 10 sets each frame so that any two successive frames overlap each other by one half of the frame length. The dividing unit 10 supplies each frame to the first windowing unit 11 sequentially in time order.

Each time a frame is received, the first windowing unit 11 multiplies the frame by a first windowing function. A windowing function that attenuates the values at both ends of the frame, for example, is used as the first windowing function. The first windowing function is given, for example, by the following equation.

$$wA(t)=(0.5-0.5\cos(2\pi t/N))^{i} \quad (1)$$

where N is the number of sample points contained in the frame, and t is the number assigned to each sample point as counted from the beginning of the frame. Further, i is a real number that satisfies the relation $0 \le i \le 1$, and is set by an instruction from the discontinuity judging unit 17. When the corrected voice signal does not become discontinuous, i is set to 1. In other words, in this case, the first windowing function is a Hanning window. On the other hand, when the corrected voice signal becomes discontinuous, i is set to a value that satisfies the relation $0<i<1$, for example, to 0.5. In other words, the amount by which the signal of the frame is attenuated by the first windowing function when the corrected voice signal becomes discontinuous is set smaller than the amount by which the signal of the frame is attenuated by the first windowing function when the corrected voice signal does not become discontinuous. This is because, when the corrected voice signal becomes discontinuous, the signal of the corrected frame is attenuated by a second windowing function.

The first windowing unit 11 supplies the frame multiplied by the first windowing function to both the orthogonal transform unit 12 and the discontinuity judging unit 17.

Each time the frame multiplied by the first windowing function is received, the orthogonal transform unit 12 applies an orthogonal transform to the frame and thereby computes a frequency spectrum for that frame. The frequency spectrum contains a frequency signal for each of a plurality of frequency bands, and each frequency signal is represented by an amplitude component and a phase component. The orthogonal transform unit 12 uses, for example, a fast Fourier transform (FFT) or a modified discrete cosine transform (MDCT) as the orthogonal transform.

The orthogonal transform unit 12 passes the frequency spectrum on a frame-by-frame basis to the frequency signal processing unit 13.

Each time the frequency spectrum of one frame is received, the frequency signal processing unit 13 computes a corrected frequency spectrum by applying signal processing to that frequency spectrum. For example, the frequency signal processing unit 13 may compute the corrected frequency spectrum by estimating the noise component contained in the frequency signal for each frequency band and by subtracting the noise component from the frequency signal. In this case, based on the frequency spectrum of the current frame which is the most recent frame, the frequency signal processing unit 13 updates a noise model representing the noise component estimated for each frequency band based, for example, on a predetermined number of past frames. In this way, the frequency signal processing unit 13 estimates the noise component for each frequency band in the current frame.

More specifically, the frequency signal processing unit 13 calculates the average value of the absolute values of the amplitude components of the frequency signals for the respective frequency bands on a frame-by-frame basis. Then, the frequency signal processing unit 13 compares the average value of the absolute values of the amplitude components of the frequency signals for the current frame with a threshold value corresponding to the upper limit of the noise component. When the average value is smaller than the threshold value, the frequency signal processing unit 13 updates the noise model by weighted-averaging the absolute values of the noise components in the past frames and the amplitude component in the current frame for each frequency band by using a forgetting factor $\alpha$. The forgetting factor $\alpha$ by which the absolute value of the amplitude component in the current frame is multiplied is set to a value in the range of 0.01 to 0.1. On the other hand, the noise components in the past frames are multiplied by $(1-\alpha)$.

On the other hand, when the average of the absolute values of the amplitude components of the current frame is not smaller than the threshold value, it is presumed that signal components other than noise are contained in the current frame; therefore, the frequency signal processing unit 13 sets the forgetting factor $\alpha$ to a very small value such as 0.0001, for example.

Then, by combining the amplitude component obtained by subtracting the noise component from the amplitude component of the frequency signal with the phase component of the original frequency signal for each frequency band of the current frame, the frequency signal processing unit 13 obtains the corrected frequency spectrum with the noise component suppressed. The frequency signal processing unit 13 may combine the amplitude component with the phase component after the amplitude component obtained by subtracting the noise component from the amplitude component of the frequency signal has been multiplied by a predetermined gain.

Each time the corrected frequency spectrum for one frame is thus obtained, the frequency signal processing unit 13 passes the corrected frequency spectrum to the inverse orthogonal transform unit 14.

The frequency signal processing unit 13 may obtain the corrected frequency spectrum by applying noise suppression and other signal processing, such as enhancement of the signal component contained in the voice signal, to the frequency spectrum. For example, the frequency signal processing unit 13 may obtain the corrected frequency spectrum by multiplying the frequency signal for each frequency band by a transfer function that suppresses reverberations.

Each time the corrected frequency spectrum is received, the inverse orthogonal transform unit 14 applies an inverse orthogonal transform to the corrected frequency spectrum and thereby transforms it into a time domain signal to produce a corrected frame containing a frame-by-frame corrected voice signal. The inverse orthogonal transform applied is the inverse of the orthogonal transform applied by the orthogonal transform unit 12.

Each time the corrected frame is obtained, the inverse orthogonal transform unit 14 passes the corrected frame to both the second windowing unit 15 and the discontinuity judging unit 17.

Each time the corrected frame is received from the inverse orthogonal transform unit 14, the second windowing unit 15 multiplies the corrected frame by the second windowing function. The second windowing function is given, for example, by the following equation.

$$wB(t)=(0.5-0.5\cos(2\pi t/N))^{1-i} \tag{2}$$

where N is the number of sample points contained in the frame, and t is the number assigned to each sample point as counted from the beginning of the frame. Further, i is a real number that falls within a range defined by the relation $0<i\leq 1$, and is set by an instruction from the discontinuity judging unit 17. In the present embodiment, as is apparent from the equations (1) and (2), the multiplication of the first and second windowing functions results in a Hanning window. This therefore suppresses the distortion of the corrected voice signal obtained by adding up successively overlapping corrected frames. When the corrected voice signal does not become discontinuous if two successive corrected frames are added up, i.e., when the continuity of the corrected voice signal is maintained, i is set to 1. In this case, wB(t) is 1 for all values of t. In other words, the second windowing unit 15 does not attenuate the corrected voice signal in the corrected frame. On the other hand, when the corrected voice signal becomes discontinuous if two successive corrected frames are added up, i is set to a value that satisfies the relation $0<i<1$, for example, to 0.5. Accordingly, in this case, the second windowing unit 15 attenuates the corrected voice signal at both ends of the corrected frame.

The second windowing unit 15 supplies the corrected frame multiplied by the second windowing function to the addition unit 16.

Each time the corrected frame is received from the second windowing unit 15, the addition unit 16 adds the corrected frame to the immediately preceding corrected frame by making them overlap each other by a predetermined amount, for example, by one half of the frame length. The adding unit 16 produces a corrected voice signal. Then, the adding unit 16 outputs the corrected voice signal.

When the corrected frame is received from the inverse orthogonal transform unit 14, the discontinuity judging unit 17 judges whether the corrected voice signal becomes discontinuous when two successive corrected frames are added up.

Figure 3A:
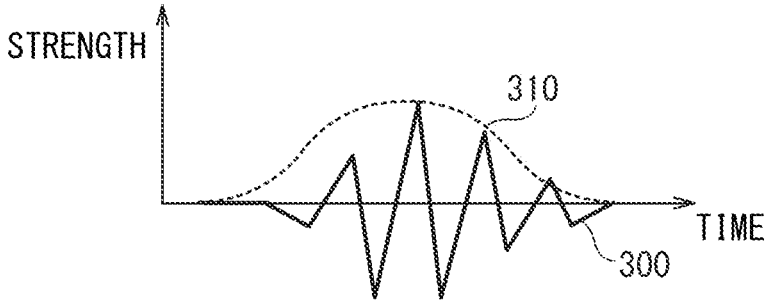
FIG. 3A is a diagram illustrating one example of a corrected frame when a corrected voice signal does not become discontinuous.
Figure 3B:
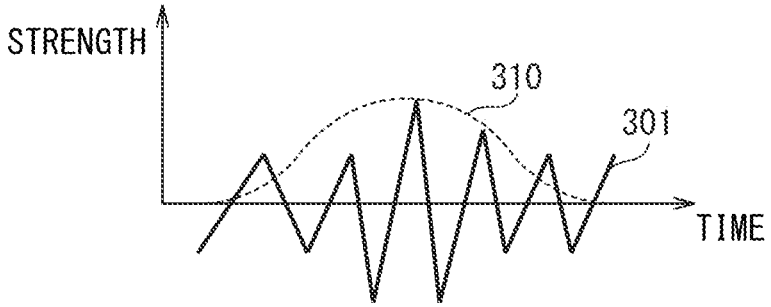
FIG. 3B is a diagram illustrating one example of a corrected frame when the corrected voice signal becomes discontinuous.

FIG. 3A is a diagram illustrating one example of a corrected frame when the corrected voice signal does not become discontinuous. FIG. 3B is a diagram illustrating one example of a corrected frame when the corrected voice signal becomes discontinuous. In FIGS. 3A and 3B, the abscissa represents the time, and the ordinate represents the signal strength. In FIG. 3A, the amplitude of the corrected voice signal 300 in the corrected frame is almost always held below the first windowing function 310, and the magnitude of its signal value at both ends of the corrected frame is very small, for example, as small as zero. As a result, if successive corrected frames are added up, the continuity of the corrected voice signal can be maintained.

On the other hand, in the example illustrated in FIG. 3B, the amplitude of the corrected voice signal 301 is larger than the first windowing function 310 at both ends of the corrected frame, and the magnitude of the corrected voice signal 301 is not reduced to a very small value, for example, zero, at either end of the corrected frame. In the first place, the distortion of the corrected voice signal due to the overlapping of successive frames is suppressed by multiplying the frame by the first windowing function that reduces the magnitude of the signal value at both ends of the frame to a very small value such as zero. Therefore, if the signal value at both ends of the corrected frame is larger than the first windowing function, the amplitude of the corrected voice signal becomes too large near the portions corresponding to the ends when the successive frames are added up, and the corrected voice signal thus becomes discontinuous.

In view of the above, the discontinuity judging unit 17 calculates the average value of the strength of the corrected voice signal contained, for example, in prescribed sections at both ends of the corrected frame. If the average value is higher than a predetermined threshold value, the discontinuity judging unit 17 determines that the corrected voice signal becomes discontinuous when the two successive corrected frames are added up. On the other hand, if the average value is not higher than the predetermined threshold value, the discontinuity judging unit 17 determines that the corrected voice signal does not become discontinuous even when the two successive corrected frames are added up. For example, the prescribed sections may each be chosen to be a section of a length equal to one eighths to one quarter of the frame length as measured from the frame end. The predetermined threshold value may be set, for example, equal to the average value of the first windowing function in the prescribed section.

When the corrected voice signal becomes discontinuous as a result of adding up the two successive corrected frames, the correlation between the frame multiplied by the first windowing function but not yet orthogonal-transformed and the corrected frame computed from that frame is low. In view of this, the discontinuity judging unit 17 may calculate the correlation value r(L) between the L-th frame multiplied by the first windowing function and the L-th corrected frame, for example, in accordance with the following equation.

$$r(L) = \frac{\sum_{t=1}^{N} x_L(t) y_L(t)}{\left\{\left(\sum_{t=1}^{N} x_L(t)^2\right)^{1/2}\left(\sum_{t=1}^{N} y_L(t)^2\right)^{1/2}\right\}} \tag{3}$$

where $x_L(t)$ represents any given sample point t (t=1, 2, . . . , N) in the frame multiplied by the first windowing function, and $y_L(t)$ the corresponding sample point t in the corrected frame.

If the correlation value r(L) is lower than a threshold value Th, the discontinuity judging unit 17 determines that the corrected voice signal becomes discontinuous when the two successive corrected frames are added up. The threshold value Th is set equal to the upper limit of the correlation value below which the corrected voice signal becomes discontinuous, for example, to 0.5.

The primary source that causes the corrected voice signal to become discontinuous when two successive corrected frames are added up is not the input voice signal itself, but the signal processing performed by the frequency signal processing unit 13. Therefore, when the corrected voice signal becomes discontinuous as a result of adding up a given corrected frame and a corrected frame successive to it, it is highly likely that the corrected voice signal will also become discontinuous for the subsequent frames, unless the signal processing performed by the frequency signal processing unit 13 is changed. In view of this, once the discontinuity judging unit 17 has determined that the corrected voice signal is discontinuous, the discontinuity judging unit 17 thereafter performs the discontinuity judging process at predetermined intervals of time. The predetermined intervals of time are, for example, 0.5-second, 1-second, or 2-second intervals. This serves to reduce the number of times that the discontinuity judging unit 17 performs the discontinuity judging process. On the other hand, when the continuity of the corrected voice signal is maintained, the discontinuity judging unit 17 may judge whether the corrected voice signal becomes discontinuous or not, for example, each time a new corrected frame is received from the inverse orthogonal transform unit 14.

Based on the result of the judgment made as to whether the corrected voice signal is discontinuous or not, the discontinuity judging unit 17 controls the first windowing function to be used by the first windowing unit 11 and the second windowing function to be used by the second windowing unit 15.

In the present embodiment, if it is determined that the corrected voice signal is discontinuous when the L-th corrected frame and the corrected frame successive to it are added up, the discontinuity judging unit 17 instructs the first windowing unit 11 to split the Hanning window for the (L+1) th and subsequent frames. More specifically, the discontinuity judging unit 17 instructs the first windowing unit 11 to set the variable i in the first windowing function to be applied to each of the (L+1)th and subsequent frames to a value smaller than 1, for example, to 0.5. Further, the discontinuity judging unit 17 instructs the second windowing unit 15 to use, as the second windowing function to be applied to each of the (L+1) th and subsequent corrected frames, a windowing function that attenuates the signal at both ends of the corrected frame. More specifically, the discontinuity judging unit 17 instructs the second windowing unit 15 to set the variable i in the second windowing function to be applied to each of the (L+1) th and subsequent corrected frames to a value smaller than 1, for example, to 0.5.

On the other hand, if it is determined that the corrected voice signal is not discontinuous even when the L-th corrected frame and the corrected frame successive to it are added up, the discontinuity judging unit 17 instructs the first windowing unit 11 to apply the Hanning window to each of the (L+1)th and subsequent frames. More specifically, the discontinuity judging unit 17 instructs the first windowing unit 11 to set the variable i in the first windowing function to be applied to each of the (L+1)th and subsequent frames to 1. Further, the discontinuity judging unit 17 instructs the second windowing unit 15 to use for each of the (L+1)th and subsequent corrected frames the second windowing function that outputs the corrected frame unaltered without attenuating the signal. More specifically, the discontinuity judging unit 17 instructs the second windowing unit 15 to set the variable i in the second windowing function to be applied to each of the (L+1)th and subsequent frames to 1.

Figure 4:
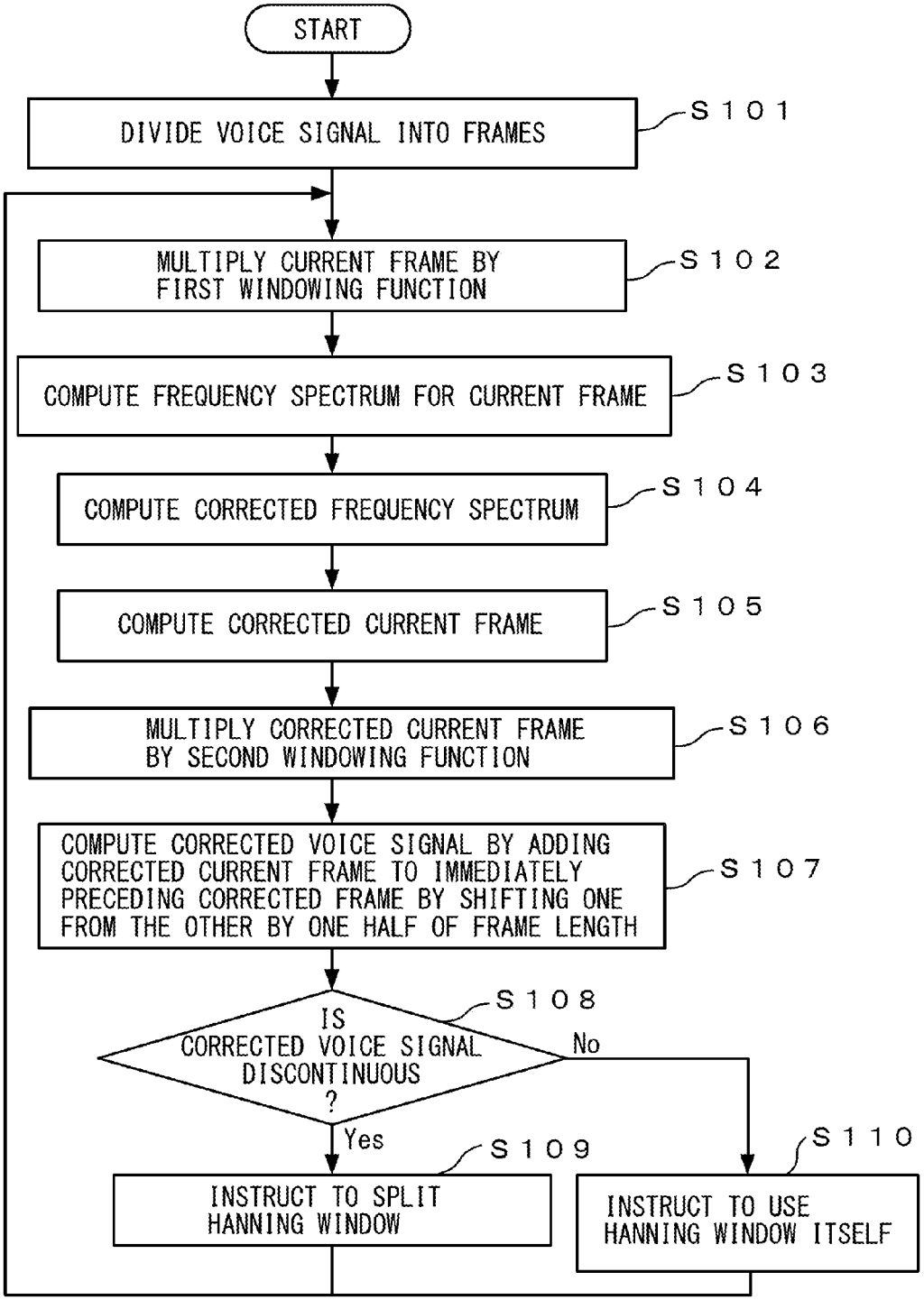
FIG. 4 is an operation flowchart of voice processing according to the first embodiment.

FIG. 4 is an operation flowchart of voice processing according to the first embodiment. The dividing unit 10 divides the voice signal into frames in such a manner that any two successive frames overlap each other by a predetermined amount, for example, by one half of the frame length (step S101). The dividing unit 10 sequentially supplies each frame to the first windowing unit 11.

The first windowing unit 11 multiplies the current frame, i.e., the most recent frame, by the first windowing function (step S102). The first windowing unit 11 supplies the current frame multiplied by the first windowing function to both the orthogonal transform unit 12 and the discontinuity judging unit 17.

The orthogonal transform unit 12 computes a frequency spectrum for the current frame by applying an orthogonal transform to the current frame multiplied by the first windowing function (step S103). The orthogonal transform unit 12 then passes the frequency spectrum to the frequency signal processing unit 13. The frequency signal processing unit 13 computes a corrected frequency spectrum by applying signal processing such as noise suppression to the frequency spectrum of the current frame (step S104). The frequency signal processing unit 13 passes the corrected frequency spectrum to the inverse orthogonal transform unit 14.

The inverse orthogonal transform unit 14 computes a corrected current frame, i.e., the corrected frame for the current frame, by applying an inverse orthogonal transform to the corrected frequency spectrum and thereby transforming it into a time domain signal (step S105). Then, the inverse orthogonal transform unit 14 passes the corrected current frame to both the second windowing unit 15 and the discontinuity judging unit 17.

The second windowing unit 15 multiplies the corrected current frame by the second windowing function (step S106). Then, the second windowing unit 15 supplies the corrected current frame multiplied by the second windowing function to the addition unit 16. The adding unit 16 computes a corrected voice signal by adding the voice signal carried in the corrected current frame multiplied by the second windowing function to the voice signal carried in the immediately preceding corrected frame by shifting one from the other by one half of the frame length (step S107).

On the other hand, the discontinuity judging unit 17 judges whether the corrected voice signal is discontinuous when the corrected current frame and the corrected frame successive to it are added up (step S108).

If it is determined that the corrected voice signal is discontinuous when the corrected current frame and the corrected frame successive to it are added up (Yes in step S108), the discontinuity judging unit 17 instructs the first windowing function 11 to split the Hanning window for the next and subsequent frames. The discontinuity judging unit 17 also instructs the second windowing function 15 to apply the split Hanning window as the second windowing function (step S109).

On the other hand, if it is determined that the continuity of the corrected voice signal can be maintained even when the corrected current frame and the corrected frame successive to it are added up (No in step S108), the discontinuity judging unit 17 instructs the first windowing function 11 to use the Hanning window itself as the first windowing function for the next and subsequent frames. Further, the discontinuity judging unit 17 instructs the second windowing function 12 to use as the second windowing function a function that does not attenuate any part of the corrected frame (step S110).

After step S109 or S110, the voice processing apparatus 5 repeats the process from step S102 onward by taking the next frame as the current frame.

Figure 5A:
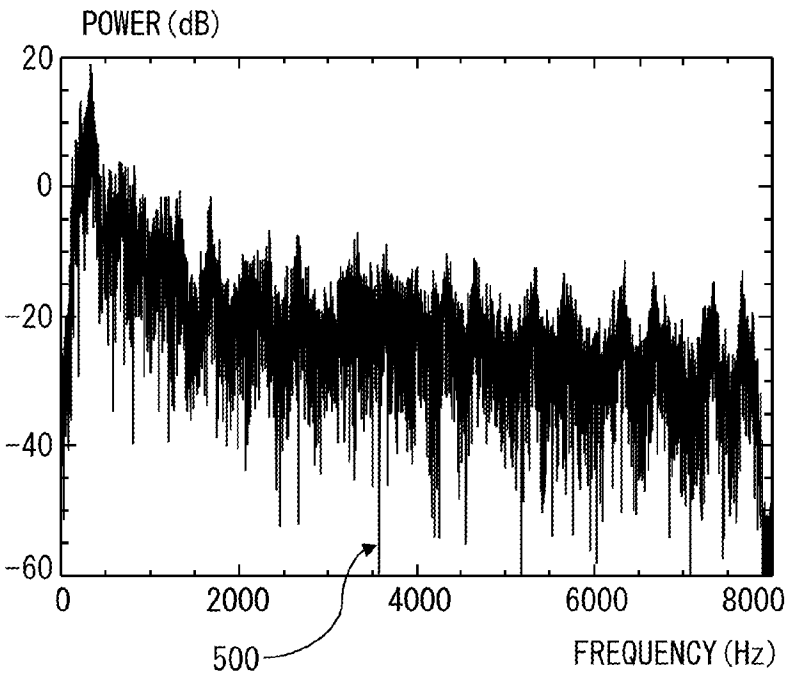
FIG. 5A is a diagram illustrating a power spectrum obtained when vehicle driving noise is suppressed by multiplying each frame only by a first windowing function, i.e., a Hanning window, for a voice signal containing the vehicle driving noise.
Figure 5B:
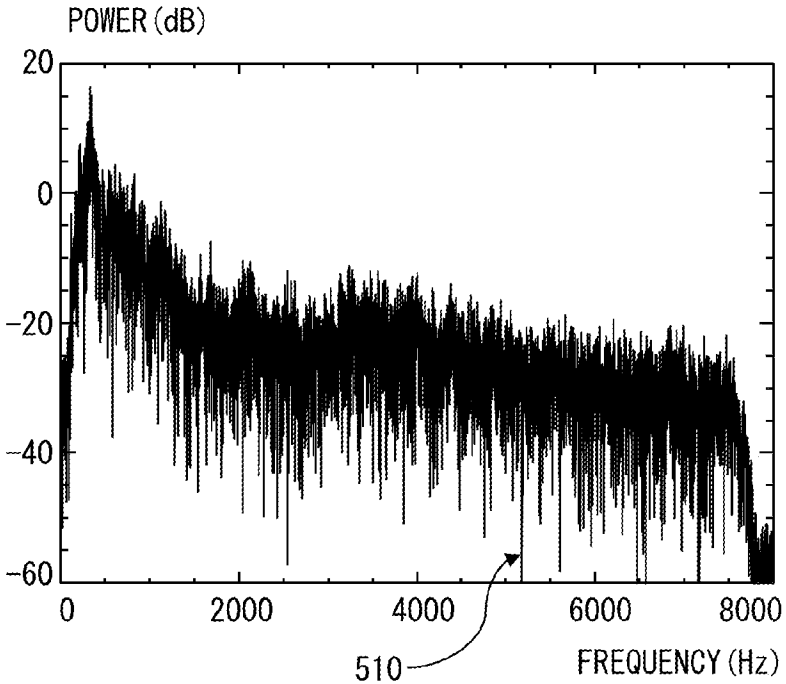
FIG. 5B is a diagram illustrating a power spectrum obtained when vehicle driving noise is suppressed by multiplying each frame by the first and second windowing functions for a voice signal containing the vehicle driving noise.

FIG. 5A is a diagram illustrating a power spectrum 500 obtained when vehicle driving noise is suppressed by multiplying each frame only by the Hanning window before applying an orthogonal transform for the voice signal containing the vehicle driving noise. On the other hand, FIG. 5B is a diagram illustrating a power spectrum 510 obtained when vehicle driving noise is suppressed by multiplying each frame by the first and second windowing functions with i=0.5 for the voice signal containing the vehicle driving noise. In FIGS. 5A and 5B, the abscissa represents the frequency, and the ordinate represents the power spectral intensity [dB]. In the illustrated example, the number of sample points contained in each frame for frequency signal processing is 32, and the amount of overlap between any two successive frames is 50%. As can be seen from the power spectrum 500, when each frame is multiplied only by the Hanning window, sixteen periodic peaks appear, which means that the spectrum is discontinuous. From this, it can be seen that the corrected voice signal is discontinuous and that periodic noise proportional to the frame length is contained in the corrected voice signal. On the other hand, as can be seen from the power spectrum 510, by multiplying each frame by the second windowing function after the inverse orthogonal transform, periodic peaks are suppressed.

As has been described above, if it is determined that the corrected voice signal is discontinuous when the corrected frames obtained by the frame-by-frame frequency signal processing are added up, the voice processing apparatus once again multiplies the corrected frame by the windowing function. In this way, the voice processing apparatus can reduce the strength of the corrected voice signal at both ends of the frame obtained by the inverse orthogonal transform. The voice processing apparatus can suppress an increase in the amount of computation while suppressing the periodic noise, because there is no need to increase the amount of frame overlapping in order to suppress the periodic noise associated with the discontinuity of the corrected voice signal.

Next, a voice processing apparatus according to a second embodiment will be described. According to this voice processing apparatus, if the result of the judgment made for the current frame as to whether the corrected voice signal is discontinuous or not differs from the result of the judgment made for the immediately preceding frame, the first and second windowing functions altered according to the result of the judgment made for the current frame are also applied to the current frame.

Figure 6:
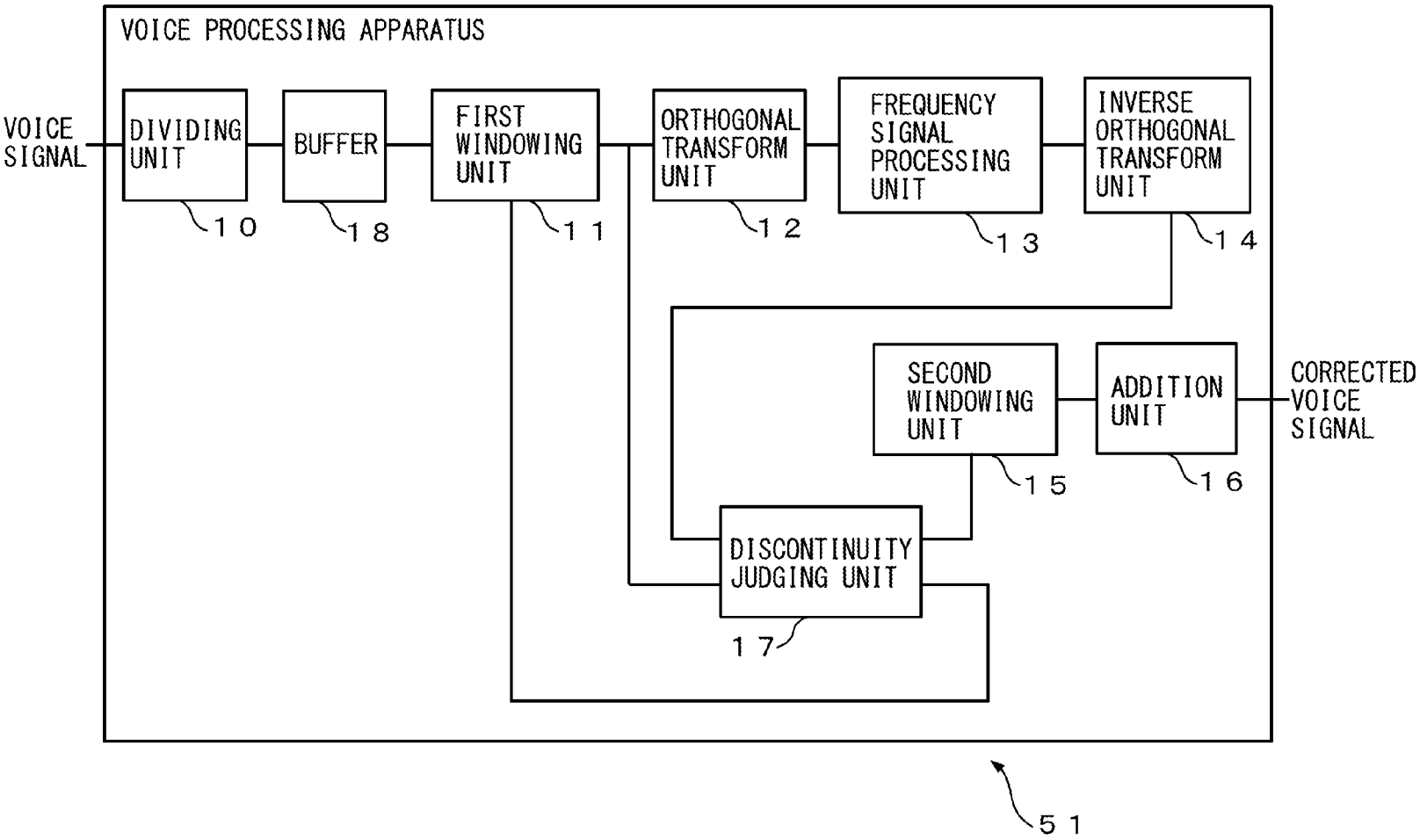
FIG. 6 is a diagram schematically illustrating the configuration of a voice processing apparatus according to a second embodiment.

FIG. 6 is a diagram schematically illustrating the configuration of the voice processing apparatus 51 according to the second embodiment. The voice processing apparatus 51 includes a dividing unit 10, a first windowing unit 11, an orthogonal transform unit 12, a frequency signal processing unit 13, an inverse orthogonal transform unit 14, a second windowing unit 15, an addition unit 16, a discontinuity judging unit 17, and a buffer 18. In FIG. 6, the component elements of the voice processing apparatus 51 are designated by the same reference numerals as those used to designate the corresponding component elements of the voice processing apparatus 5 depicted in FIG. 2.

The voice processing apparatus 51 according to the second embodiment differs from the voice processing apparatus 5 according to the first embodiment by the inclusion of the buffer 18. The following therefore describes the buffer 18 and its related parts. For the other component elements of the voice processing apparatus 51, refer to the description earlier given of the corresponding component elements of the first embodiment.

The buffer 18 includes, for example, a volatile semiconductor memory. Each time a frame is generated, the dividing unit 10 stores the frame in the buffer 18. Then, the first windowing unit 11 reads out each frame from the buffer 18 sequentially in time order, and multiplies the readout frame by the first windowing function.

If the result of the judgment made by the discontinuity judging unit 17 for the current frame as to whether the corrected voice signal is discontinuous or not differs from the result of the judgment made for the immediately preceding frame, the windowing functions to be used by the first and second windowing units 11 and 15 are altered. Thereupon, the first windowing unit 11 rereads the voice signal of the current frame from the buffer 18. Then, the first windowing unit 11 multiplies the current frame by the altered first windowing function. Further, the orthogonal transform unit 12, the frequency signal processing unit 13, and the inverse orthogonal transform unit 14 perform their respective processing over again on the current frame multiplied by the altered first windowing function. Then, the second windowing unit 11 multiplies the thus processed current frame by the altered second windowing function. The addition unit 16 then adds the corrected current frame multiplied by the altered first and second windowing functions to the immediately preceding corrected frame by shifting one from the other by a predetermined amount of overlap.

Figure 7:
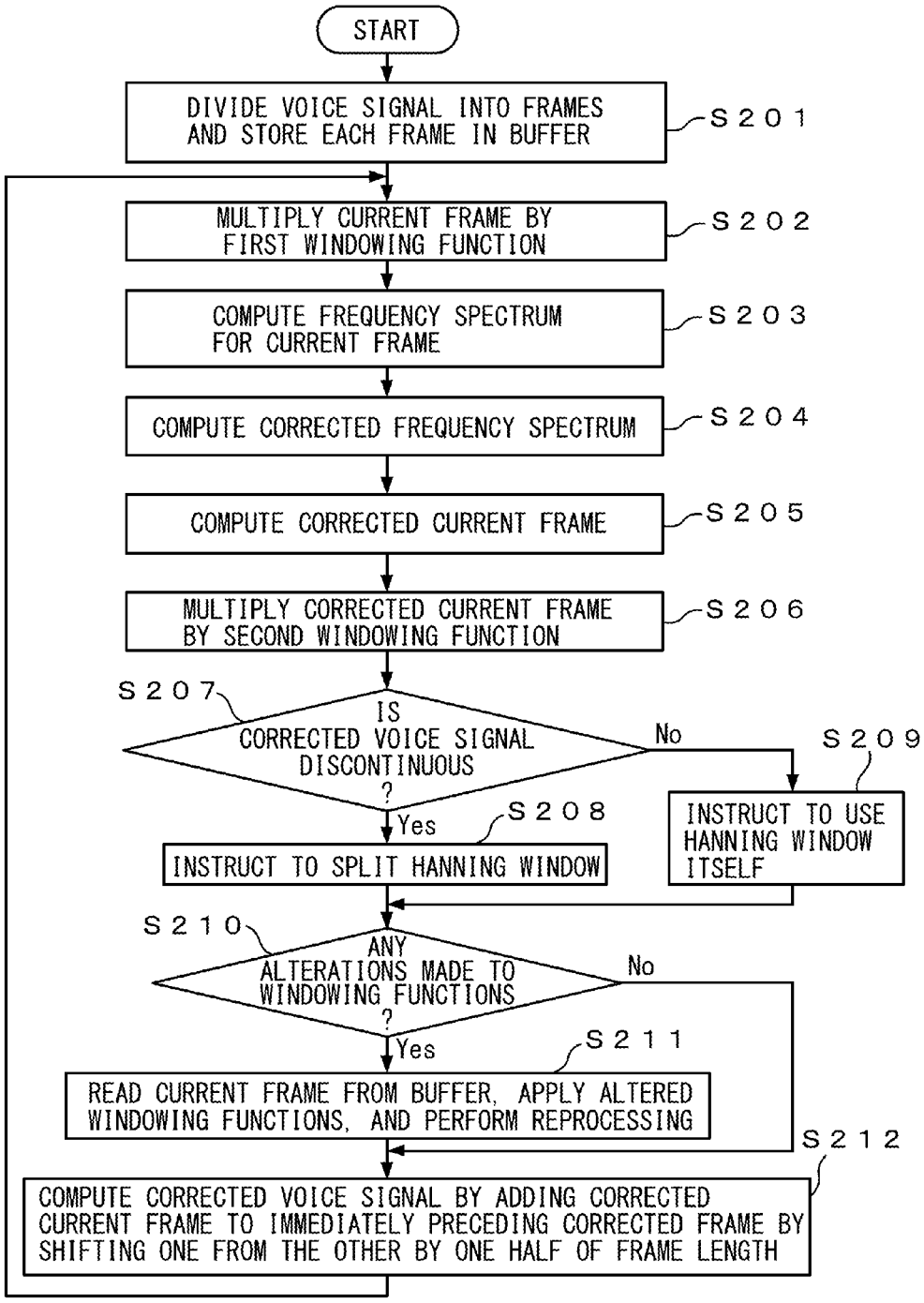
FIG. 7 is an operation flowchart of voice processing according to the second embodiment.

FIG. 7 is an operation flowchart of voice processing according to the second embodiment. The voice processing apparatus 51 performs voice processing on a frame-by-frame basis in accordance with the following operation flowchart. In the operation flowchart of FIG. 7, steps S202 to S209 are the same as the corresponding steps S102 to S106 and S108 to S110 in the operation flowchart of FIG. 4. The following description therefore deals with steps S201 and S210 to S212.

The dividing unit 10 divides the voice signal into frames in such a manner that any two successive frames overlap each other by a predetermined amount, for example, by one half of the frame length. Then, the dividing unit 10 stores each frame in the buffer 18 (step S201). The voice processing apparatus 51 then performs the process of steps S203 to S209 on the current frame.

After that, the discontinuity judging unit 17 checks to see whether any alterations have been made to the windowing functions to be applied (step S210). As described above, if the result of the discontinuity judgment made for the corrected current frame differs from the result of the discontinuity judgment made for the immediately preceding corrected frame, the windowing functions to be applied are altered. If any alterations have been made to the windowing functions to be applied (Yes in step S210), the discontinuity judging unit 17 notifies the first windowing unit 11 and the addition unit 16 that the windowing functions to be applied are altered. In this case, the addition unit 16 discards the corrected current frame. Further, the first windowing unit 11, the orthogonal transform unit 12, the frequency signal processing unit 13, the inverse orthogonal transform unit 14, and the second windowing unit 15 perform their respective processing over again on the current frame by using the altered windowing functions and thus recompute the corrected frame (step S211).

After step S211, the addition unit 16 computes the corrected voice signal by adding the corrected voice signal of the corrected current frame to the corrected voice signal of the immediately preceding corrected frame by shifting the corrected current frame from the immediately preceding corrected frame by one half of the frame length (step S212). If it is determined in step S210 that no alterations have been made to the windowing functions to be applied, i.e., if the result of the discontinuity judgment made for the corrected current frame is the same as the result of the discontinuity judgment made for the immediately preceding corrected frame (No in step S210), the process also proceeds to step S212.

After step S212, the voice processing apparatus 51 erases the current frame from the buffer 18, and repeats the process from step S202 onward.

As described above, if it is necessary to alter the windowing functions for any given frame, the voice processing apparatus according to the second embodiment can process that given frame by using the altered windowing functions. In this way, the voice processing apparatus can suppress the noise associated with the discontinuity of the corrected voice signal, starting from the earliest possible frame. Accordingly, the voice processing apparatus can be used advantageously in applications where instantaneous noise can adversely affect the result, for example, as when the processed voice signal is used for voice recognition.

According to a modified example, the discontinuity judging unit 17 may be omitted. In that case, the first and second windowing units 11 and 15 always use the split Hanning windows, i.e., the equations (1) and (2) where i satisfies the condition $0<i<1$, as the first and second windowing functions, respectively. In particular, when the number of sample points contained in the frame is small, for example, when the number of sample points is in the range of 16 to 32, if periodic noise occurs due to the discontinuity of the corrected voice signal, the noise significantly reduces the quality of the corrected voice signal because the period of the noise is short. Therefore, by always multiplying each corrected frame by the windowing functions that attenuate the signal near the frame end, the voice processing apparatus according to this modified example can suppress the noise associated with the discontinuity of the corrected voice signal at all times.

According to another modified example, when a windowing function that attenuates the signal at both ends of the corrected frame is applied as the second windowing function, the ratio between the first and second windowing functions may be adjusted for each frame. For example, when the signal strength near both ends of the frame is high from the outset, discontinuity can easily occur in the corrected voice signal between that frame and the frame successive to it. In view of this, the discontinuity judging unit 17 may compute, for example, for each frame, the average value of the absolute values of the signal strengths in prescribed sections near both ends of the frame, and may increase the amount of signal attenuation due to the first windowing function and reduce the amount of signal attenuation due to the second windowing function as the average value becomes higher. That is, in the equations (1) and (2), the discontinuity judging unit 17 increases the value of i as the average value of the absolute values of the signal strengths in prescribed sections near both ends of the frame becomes higher. Then for example when the average value becomes equal to or higher than a predetermined threshold value, the discontinuity judging unit 17 sets the value of i to 0.75.

According to still another modified example, the first and second windowing functions may be set so that the product of the first and second windowing functions yield another windowing function whose value is substantially constant when the frames are added up by shifting one from the other by an amount equal to a prescribed fraction of the frame length.

The voice processing apparatus according to any of the above embodiments or their modified examples can be applied not only to hands-free phones but also to other voice input systems such as mobile phones or loudspeakers.

Further, the voice processing apparatus according to any of the above embodiments or their modified examples may be incorporated, for example, in a mobile phone and may be configured to correct the voice signal generated by some other apparatus. In this case, the voice signal corrected by the voice processing apparatus is reproduced through a speaker built into the device equipped with the voice processing apparatus.

A computer program for causing a computer to implement the functions of the various units constituting the voice processing apparatus according to any of the above embodiments may be provided in the form recorded on a computer-readable medium such as a magnetic recording medium or an optical recording medium. The term "recording medium" here does not include a carrier wave.

Figure 8:
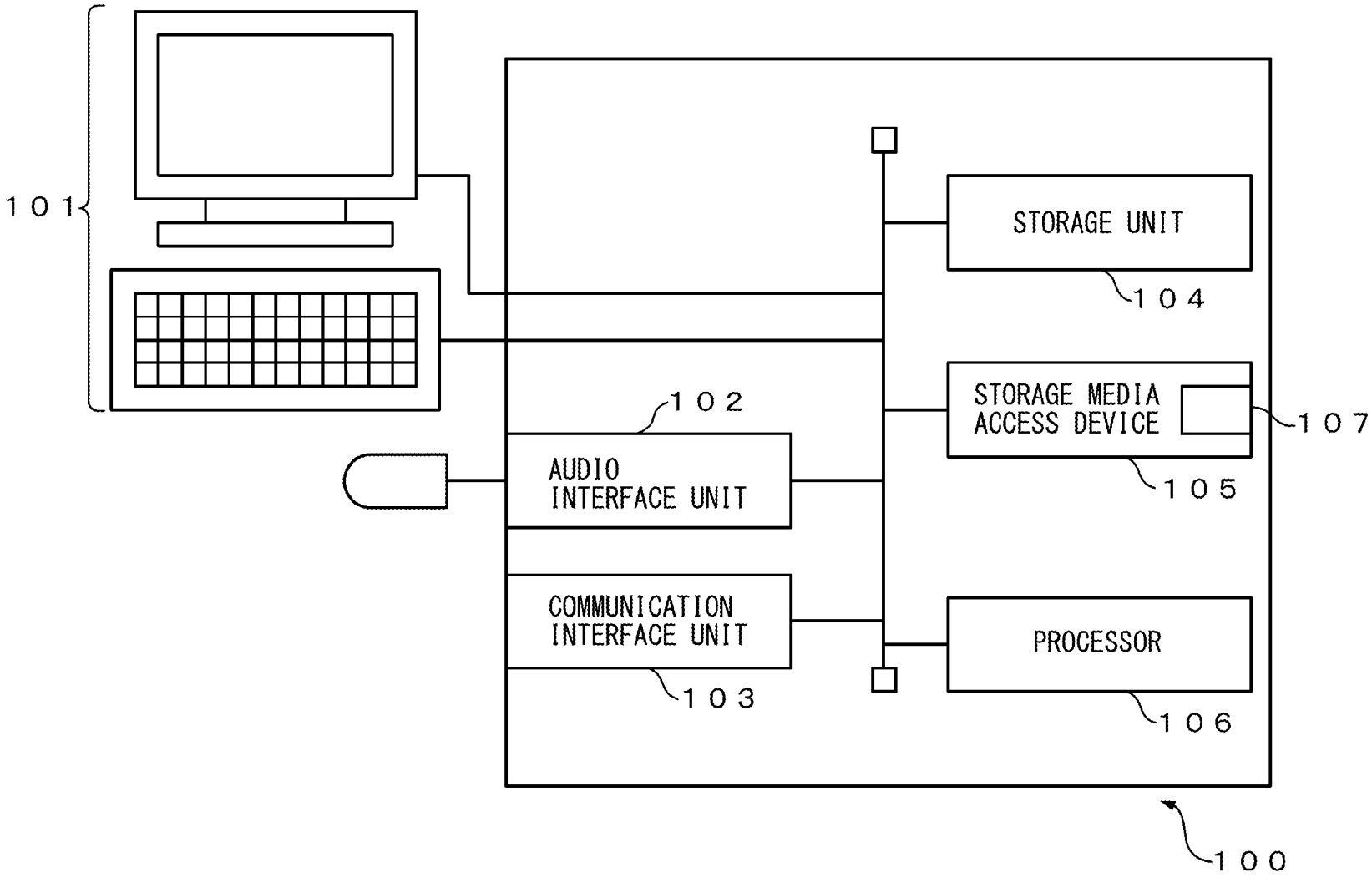
FIG. 8 is a diagram illustrating the configuration of a computer that operates as a voice processing apparatus by executing a computer program for implementing the functions of the various units constituting the voice processing apparatus according to any one of the above embodiments or their modified examples.

FIG. 8 is a diagram illustrating the configuration of a computer that operates as a voice processing apparatus by executing a computer program for implementing the functions of the various units constituting the voice processing apparatus according to any one of the above embodiments or their modified examples.

The computer 100 includes a user interface unit 101, an audio interface unit 102, a communication interface unit 103, a storage unit 104, a storage media access device 105, and a processor 106. The processor 106 is connected to the user interface unit 101, the audio interface unit 102, the communication interface unit 103, the storage unit 104, and the storage media access device 105, for example, via a bus.

The user interface unit 101 includes, for example, an input device such as a keyboard and a mouse, and a display device such as a liquid crystal display. Alternatively, the user interface unit 101 may include a device, such as a touch panel display, into which an input device and a display device are integrated. The user interface unit 101 then, for example, in response to a user operation, outputs an operation signal instructing the processor 106 to initiate voice processing for the voice signal that is input via the audio interface unit 102.

The audio interface unit 102 includes an interface circuit for connecting the computer 100 to a voice input device such as a microphone that generates the voice signal. The audio interface unit 102 acquires the voice signal from the voice input device and passes the voice signal to the processor 106.

The communication interface unit 103 includes a communication interface for connecting the computer 100 to a communication network conforming to a communication standard such as the Ethernet (registered trademark), and a control circuit for the communication interface. The communication interface unit 103 receives a data stream containing the corrected voice signal from the processor 106, and outputs the data stream onto the communication network for transmission to another apparatus. Further, the communication interface unit 103 may acquire a data stream containing a voice signal from another apparatus connected to the communication network, and may pass the data stream to the processor 106.

The storage unit 104 includes, for example, a readable/writable semiconductor memory and a read-only semiconductor memory. The storage unit 104 stores a computer program for implementing the voice processing to be executed on the processor 106, and the data generated as a result of or during the execution of the program.

The storage media access device 105 is a device that accesses a storage medium 107 such as a magnetic disk, a semiconductor memory card, or an optical storage medium. The storage media access device 105 accesses the storage medium 107 to read out, for example, the voice processing computer program to be executed on the processor 106, and passes the readout computer program to the processor 106.

The processor 106 executes the voice processing computer program according to any one of the above embodiments or their modified examples and thereby corrects the voice signal received via the audio interface unit 102 or via the communication interface unit 103. The processor 106 then stores the corrected voice signal in the storage unit 104, or transmits the corrected voice signal to another apparatus via the communication interface unit 103.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority and inferiority of the invention. Although the embodiments of the present invention have been described in detail, it should be understood that the various changes, substitutions, and alterations could be made hereto without departing from the spirit and scope of the invention.

What is claimed is:

1. A voice processing apparatus comprising:

a dividing unit which divides a voice signal into frames, each frame having a predetermined length of time, in such a manner that any two temporally successive frames overlap each other by a predetermined amount;

a first windowing unit which multiplies each frame by a first windowing function that attenuates a signal at both ends of the frame;

an orthogonal transform unit which applies an orthogonal transform to each frame multiplied by the first windowing function to compute a frequency spectrum on a frame-by-frame basis;

a frequency signal processing unit which applies signal processing to the frequency spectrum to compute a corrected frequency spectrum on a frame-by-frame basis;

an inverse orthogonal transform unit which applies an inverse orthogonal transform to the corrected frequency spectrum to compute a corrected frame on a frame-by-frame basis;

a second windowing unit which multiplies each corrected frame by a second windowing function that attenuates a signal at both ends of the corrected frame; and an addition unit which computes a corrected voice signal by adding up the corrected frames, each multiplied by the second windowing function, sequentially in time order while allowing one to overlap another by the predetermined amount.

2. The voice processing apparatus according to claim 1, wherein the first windowing function and the second windowing function are set in such a manner that a function obtained by multiplying the first windowing function by the second windowing function is a Hanning window.

3. The voice processing apparatus according to claim 1, further comprising a discontinuity judging unit which judges whether the corrected voice signal is discontinuous or not when a first corrected frame corresponding to a first frame of the plurality of frames is added to another corrected frame that is temporally successive to the first corrected frame, and which, when the corrected voice signal is discontinuous, sets the second windowing function as a function that attenuates the signal at both ends of the corrected frame but, when the corrected voice signal is not discontinuous, sets the second windowing function as a function that does not attenuate any part of the signal in the corrected frame, and sets the first windowing function so that the amount by which the signal contained in the frame is attenuated by the first windowing function becomes smaller than the amount by which the signal contained in the frame is attenuated by the first windowing function when the corrected voice signal is discontinuous.

4. The voice processing apparatus according to claim 3, further comprising a buffer, and wherein:

the dividing unit stores the first frame in the buffer, when the result of the judgment made for the first corrected frame as to whether the corrected voice signal is discontinuous or not differs from the result of the judgment made for the corrected frame immediately preceding the first corrected frame as to whether the corrected voice signal is discontinuous or not, the first windowing unit reads out the first frame from the buffer, and generates a reprocessed frame by multiplying the readout first frame by the first windowing function that has been set according to the result of the judgment made for the first corrected frame as to whether the corrected voice signal is discontinuous or not, the orthogonal transform unit computes a frequency spectrum for the reprocessed frame by applying an orthogonal transform to the reprocessed frame, the frequency signal processing unit computes a corrected frequency spectrum for the reprocessed frame, the inverse orthogonal transform unit computes a corrected reprocessed frame by applying an inverse orthogonal transform to the corrected frequency spectrum of the reprocessed frame, the second windowing unit computes an attenuated reprocessed frame by multiplying the corrected reprocessed frame by the second windowing function that has been set according to the result of the judgment made for the first corrected frame as to whether the corrected voice signal is discontinuous or not, and the addition unit computes the corrected voice signal by adding the attenuated reprocessed frame to the immediately preceding corrected frame in such a manner as to make one overlap the other by the predetermined amount.

5. The voice processing apparatus according to claim 3, wherein the discontinuity judging unit computes a cross-correlation value between the first corrected frame and the first frame and, when the cross-correlation value is lower than a first threshold value, determines that the corrected voice signal is discontinuous.

6. The voice processing apparatus according to claim 3, wherein the discontinuity judging unit computes an average value of the absolute values of the strengths of the signals contained in prescribed sections at both ends of the first corrected frame and, when the average value is higher than a second threshold value, determines that the corrected voice signal is discontinuous.

7. The voice processing apparatus according to claim 3, wherein when it is determined for the first corrected frame that the corrected voice signal is discontinuous, the discontinuity judging unit computes an average value of the absolute values of the strengths of the signals contained in prescribed sections at both ends of the first frame and sets the amount of attenuation due to the first windowing function larger than the amount of attenuation due to the second windowing function as the average value becomes higher.

8. A voice processing method comprising:

dividing a voice signal into frames, each frame having a predetermined length of time, in such a manner that any two temporally successive frames overlap each other by a predetermined amount by a processor;

multiplying each frame by a first windowing function that attenuates a signal at both ends of the frame by the processor;

applying an orthogonal transform to each frame multiplied by the first windowing function to compute a frequency spectrum on a frame-by-frame basis by the processor;

applying signal processing to the frequency spectrum to compute a corrected frequency spectrum on a frame-by-frame basis by the processor;

applying an inverse orthogonal transform to the corrected frequency spectrum to compute a corrected frame on a frame-by-frame basis by the processor;

multiplying each corrected frame by a second windowing function that attenuates a signal at both ends of the corrected frame by the processor; and computing a corrected voice signal by adding up the corrected frames, each multiplied by the second windowing function, sequentially in time order while allowing one to overlap another by the predetermined amount by the processor.

9. The voice processing method according to claim 8, wherein the first windowing function and the second windowing function are set in such a manner that a function obtained by multiplying the first windowing function by the second windowing function is a Hanning window.

10. The voice processing method according to claim 8, further comprising:

judging, by the processor, whether the corrected voice signal is discontinuous or not when a first corrected frame corresponding to a first frame of the plurality of frames is added to another corrected frame that is temporally successive to the first corrected frame, and when the corrected voice signal is discontinuous, setting, by the processor, the second windowing function as a function that attenuates the signal at both ends of the corrected frame, but, when the corrected voice signal is not discontinuous, setting, by the processor, the second windowing function as a function that does not attenuate any part of the signal in the corrected frame, and setting, by the processor, the first windowing function so that the amount by which the signal contained in the frame is attenuated by the first windowing function becomes smaller than the amount by which the signal contained in the frame is attenuated by the first windowing function when the corrected voice signal is discontinuous.

11. The voice processing method according to claim 10, further comprising:

storing the first frame in a buffer, by the processor; and wherein:

when the result of the judgment made for the first corrected frame as to whether the corrected voice signal is discontinuous or not differs from the result of the judgment made for the corrected frame immediately preceding the first corrected frame as to whether the corrected voice signal is discontinuous or not, the multiplying each frame by the first windowing function reads out the first frame from the buffer, and generates a reprocessed frame by multiplying the readout first frame by the first windowing function that has been set according to the result of the judgment made for the first corrected frame as to whether the corrected voice signal is discontinuous or not, the applying the orthogonal transform to each frame computes a frequency spectrum for the reprocessed frame by applying an orthogonal transform to the reprocessed frame, the applying signal processing to the frequency spectrum computes a corrected frequency spectrum for the reprocessed frame, the applying the inverse orthogonal transform to the corrected frequency spectrum computes a corrected reprocessed frame by applying an inverse orthogonal transform to the corrected frequency spectrum of the reprocessed frame, the multiplying each corrected frame by the second windowing function computes an attenuated reprocessed frame by multiplying the corrected reprocessed frame by the second windowing function that has been set according to the result of the judgment made for the first corrected frame as to whether the corrected voice signal is discontinuous or not, and the computing the corrected voice signal computes the corrected voice signal by adding the attenuated reprocessed frame to the immediately preceding corrected frame in such a manner as to make one overlap the other by the predetermined amount.

12. The voice processing method according to claim 10, wherein the judging whether the corrected voice signal is discontinuous or not computes a cross-correlation value between the first corrected frame and the first frame and, when the cross-correlation value is lower than a first threshold value, determines that the corrected voice signal is discontinuous.

13. The voice processing method according to claim 10, wherein the judging whether the corrected voice signal is discontinuous or not computes an average value of the absolute values of the strengths of the signals contained in prescribed sections at both ends of the first corrected frame and, when the average value is higher than a second threshold value, determines that the corrected voice signal is discontinuous.

14. The voice processing method according to claim 10, wherein when it is determined for the first corrected frame that the corrected voice signal is discontinuous, the judging whether the corrected voice signal is discontinuous or not computes an average value of the absolute values of the strengths of the signals contained in prescribed sections at both ends of the first frame and sets the amount of attenuation due to the first windowing function larger than the amount of attenuation due to the second windowing function as the average value becomes higher.

15. A non-transitory computer-readable recording medium having recorded thereon a voice processing computer program that causes a computer to execute a process comprising:

dividing a voice signal into frames, each frame having a predetermined length of time, in such a manner that any two temporally successive frames overlap each other by a predetermined amount;

multiplying each frame by a first windowing function that attenuates a signal at both ends of the frame;

applying an orthogonal transform to each frame multiplied by the first windowing function to compute a frequency spectrum on a frame-by-frame basis;

applying signal processing to the frequency spectrum to compute a corrected frequency spectrum on a frame-by-frame basis;

applying an inverse orthogonal transform to the corrected frequency spectrum to compute a corrected frame on a frame-by-frame basis;

multiplying each corrected frame by a second windowing function that attenuates a signal at both ends of the corrected frame; and computing a corrected voice signal by adding up the corrected frames, each multiplied by the second windowing function, sequentially in time order while allowing one to overlap another by the predetermined amount.

* * * * *